United States Patent [19]

Walker

[11] Patent Number: 4,825,805

[45] Date of Patent: May 2, 1989

[54] DEVICE AND METHOD FOR PROTECTING WATER SPRINKLERS WHILE PAINTING

[75] Inventor: Robert C. Walker, Santa Ana, Calif.

[73] Assignee: Haslam & Walker Enterprises, Inc., Garden Grove, Calif.

[21] Appl. No.: 198,389

[22] Filed: May 24, 1988

Related U.S. Application Data

[63] Continuation-in-part of Ser. No. 49,286, May 12, 1987, Pat. No. 4,747,366.

[51] Int. Cl.[4] ..... B05C 11/16

[52] U.S. Cl. ..... 118/504; 118/505; 118/301; 427/252; 427/300

[58] Field of Search ..... 118/504, 505, 301; 427/282, 300

*Primary Examiner*—Thurman K. Page
*Assistant Examiner*—L. R. Horne
*Attorney, Agent, or Firm*—Klein & Szekeres

[57] ABSTRACT

A device for protecting the beauty rims of ceilng-mounted water sprinklers comprises a shield member having a closed end removably attached to one end of an elongate handle. The shield member has an open end, the interior surface of which may be provided with a ring of adhesive material. In one preferred embodiment, the shield member is attachable to the beauty rim solely by the adhesive material. In another preferred embodiment, the shield member has a plurality of longitudinal, inwardly-directed ribs that are frictionally engageable against the protective receptacle within the beauty rim of the sprinkler on which the shield is installed.

5 Claims, 2 Drawing Sheets

FIG. 1
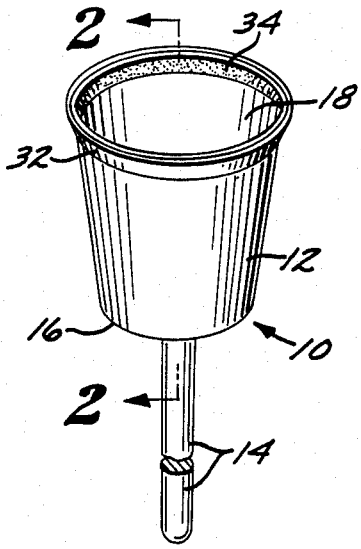
FIG. 2
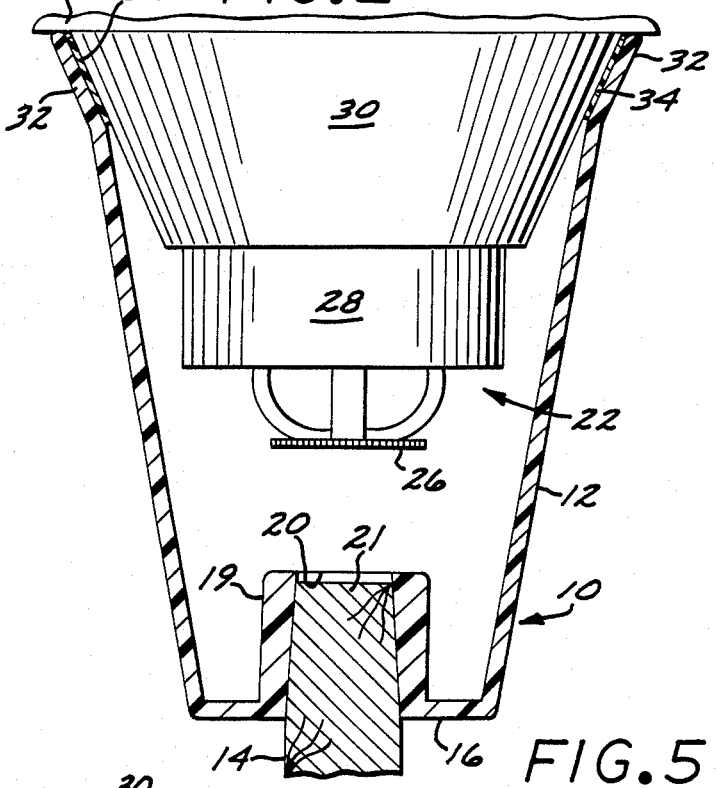
FIG. 5
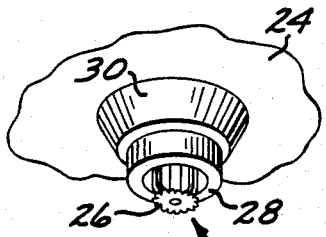
FIG. 3
FIG. 4
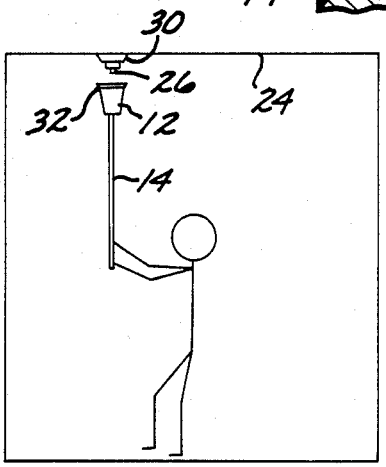
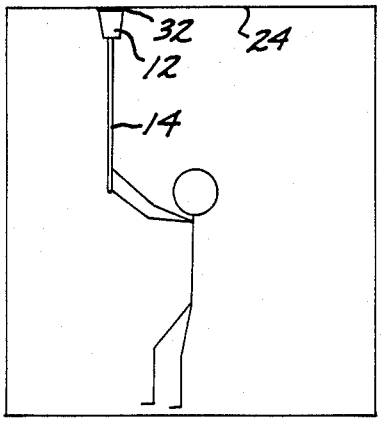
FIG. 6
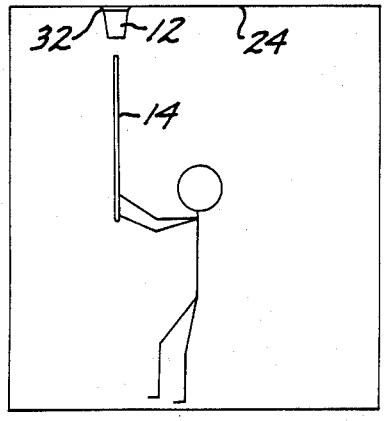
FIG. 7
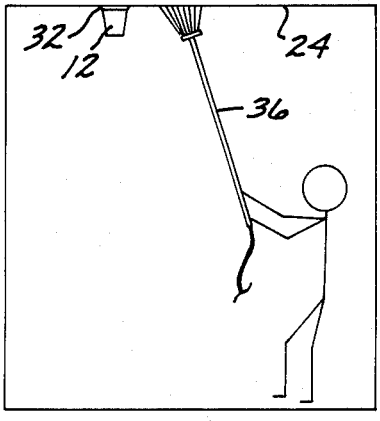
FIG. 8
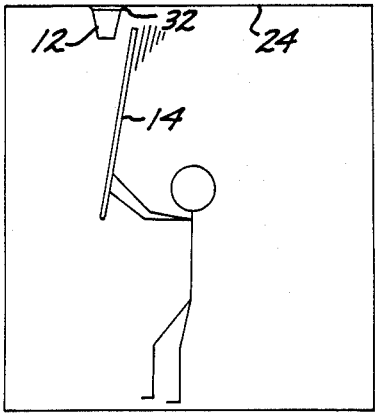

FIG. 9
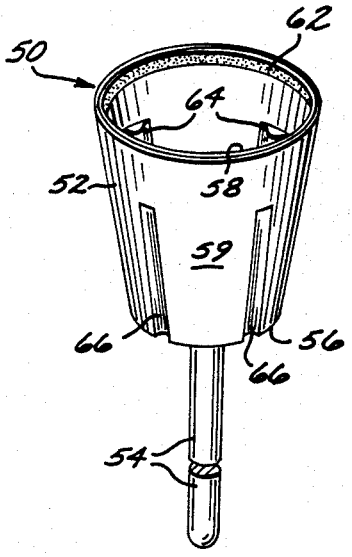
FIG. 10
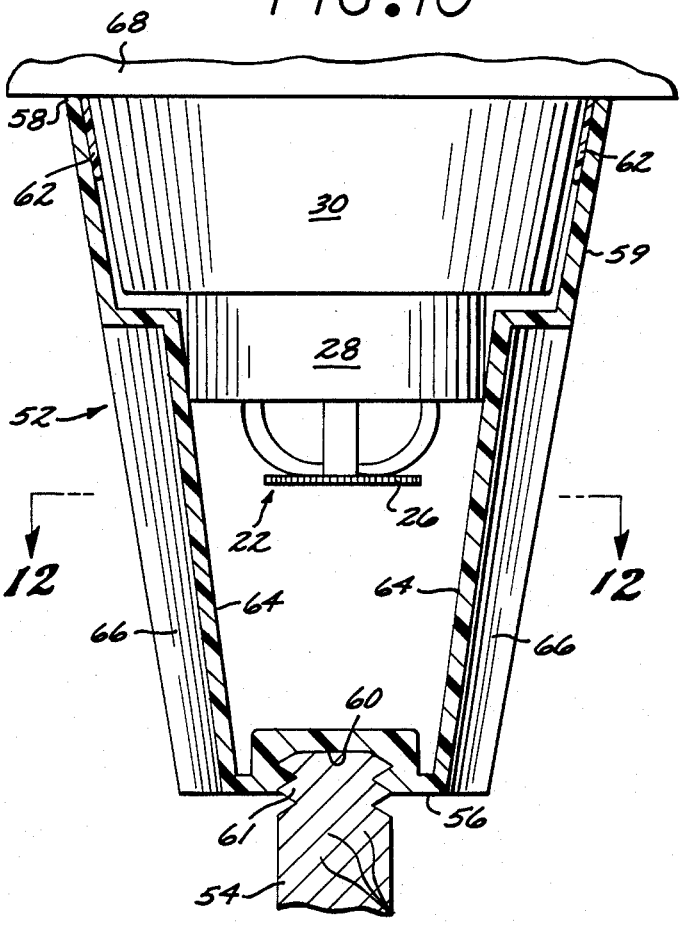
FIG. 11
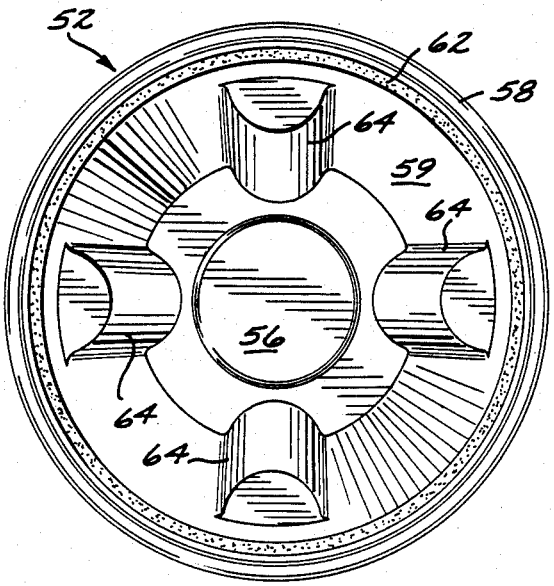
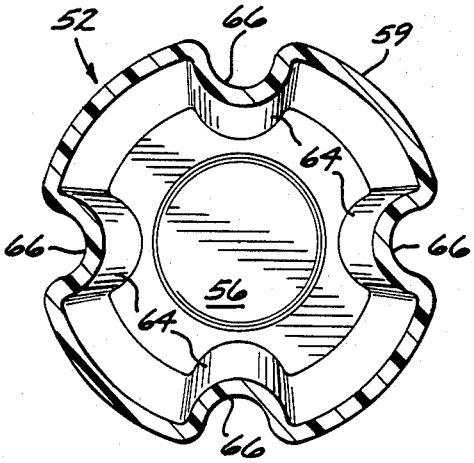
FIG. 12

DEVICE AND METHOD FOR PROTECTING WATER SPRINKLERS WHILE PAINTING

CROSS-REFERENCE TO RELATED APPLICATION

This application is a Continuation-in-Part of application Ser. No. 07/049,286, filed May 12, 1987, now U.S. Pat. No. 4,747,366.

BACKGROUND OF THE INVENTION

This invention relates to the general field of painting devices and methods. More particularly, it relates to a device that facilitates the painting of ceilings that have sprinkler systems installed therein, and to the method of using such a device.

Water sprinkler systems installed in ceilings are in common use for fire protection Such systems pose special problems, however, when the ceiling is to be painted In particular, there is a problem with keeping paint from being applied to the protective and decorative rims (sometimes called "beauty rims") which surround the sprinkler heads. Typically, the protection of these rims while painting has required the laborious effort of taping over the beauty rims prior to painting, and then removing the tape after painting. A fairly recent innovation is the use of a hand-held, removable shield to cover the sprinklers The use of this shield, however, requires the efforts of at least two people: one to hold the protective shield over each sprinkler rim, while the other paints the surrounding ceiling area. This "team" moves from sprinkler to sprinkler until the ceiling is painted. The shield used with this method is typically a cup-shaped device fixed to the end of a pole. This prior art device is similar to the "Door Knob Shield" disclosed in U.S. Pat. No. 4,327,663 to Izzo, but with a much longer handle, allowing the user to reach the ceiling-mounted sprinkler while standing on the floor While the above-described prior art device can produce satisfactory results if skillfully used, it is inefficient due to the need for an extra person just to handle the shield device.

There has thus been a long-felt, but as yet unsatisfied, need for some means to protect the sprinkler rims that eliminates the requirement for a separate shield-handler, thereby allowing the painter to work alone.

SUMMARY OF THE INVENTION

Briefly, the present invention is a paint shielding device for sprinkler rims, comprising a shield element having an open end and a closed end, with its closed end removably attached to a long handle The open end of the shield element is dimensioned to encompass the exterior surface of the sprinkler rims to be protected The inside surface of the open end has an adhesive applied to it, allowing the shield element to stick to the rim.

The present invention also encompasses the method of using the novel shielding device. Specifically, a shield element is first attached to one end of the handle The handle is then used to place the shield element over the sprinkler, allowing the shield element to stick to the rim by means of the adhesive. The handle is then removed from the shield element, which remains stuck to the rim. A new shield element is attached to the handle, and the process is repeated with the next sprinkler, and so on, until all sprinklers in the room are covered. The ceiling is then painted. When painting is completed, the handle is used to dislodge the shield elements from the sprinklers.

In the preferred embodiments of the invention the shield element is a frusto-conical cup, open at its wider and, and with a socket in its closed narrower end. The socket receives the end of the pole with either a threaded fitting or a frictional fit, to facilitate removal. In a first preferred embodiment, the open end of the cup has a flared lip. In both embodiments, the inner surface of the lip or rim is provided with a ring of double-sided tape for removable attachment to the sprinkler rim.

As will be better appreciated from the detailed description which follows, the present invention allows one person both to paint a ceiling while also protecting the sprinkler rims, thereby eliminating the previous need for an extra worker.

BRIEF DESCRIPTION OF THE DRAWINGS

FIG. 1 is a perspective view of a paint-shielding device in accordance with a first preferred embodiment of the present invention;

FIG. 2 shows the device of FIG. 1, taken in cross-section along line 2—2 of FIG. 1, installed on a typical ceiling-mounted water sprinkler;

FIG. 3 is a perspective view of a typical ceiling-mounted water sprinkler, of the type shown in FIG. 42;

FIGS. 4 through 8 are simplified representations of the paint-shielding device of FIG. 1 in use, showing its method of use;

FIG. 9 is a perspective view of a paint-shielding in accordance with a second preferred embodiment of the invention;

FIG. 10 is a longitudinal cross-sectional view of the device of FIG. 9, showing the device installed on a ceiling-mounted water sprinkler;

FIG. 11 is a top plan view of the device of FIG. 9; and

FIG. 12 is a lateral cross-sectional view, taken along line 12—12 of FIG. 10

DETAILED DESCRIPTION OF THE INVENTION

A paint-shielding device 10, in accordance with a first preferred embodiment of the present invention, is shown in detail in FIGS. 1 and 2. The device 10 comprises a shield or cover member 12 removably attached to one end of a handle 14. The shield member 12 is preferably in the general form of a frusto-conical cup, having a closed narrow end 16 and a wider, open end 18. The closed end 16 has a central recess 19 that forms a socket 20. As shown in FIG. 2, the socket 20 is dimensioned to receive one end 21 of the handle 14 with a snug frictional fit.

The shield member 12 is dimensioned to cover a water sprinkler 22, of the type that is typically installed in a ceiling 24 for fire protection The sprinkler 22 (shown in FIGS. 2 and 3) comprises a sprinkler head 26 which protrudes downwardly from an annular protective receptacle 28 Surrounding the receptacle 28 and concentric therewith, is a protective and decorative annular rim 30 (sometimes called a "beauty rim"), the upper end of which abuts against the ceiling.

Referring once again to FIGS. 1 and 2, the shield member 12 has an outwardly-flared lip 32 terminating its open end 18. The inner surface of the lip 32 is provided with an adhesive ring 34. This adhesive ring 34 is preferably formed of a double-sided tape (i.e., a tape with adhesive on both sides). Other types of adhesive materials may be used as well. As shown in FIG. 2, the interior of the lip 32 is dimensioned and configured to conform to the exterior surface of the beauty rim 30, allowing the adhesive ring 34 to adhere to the rim 30 when the shield member 12 is then placed over the sprinkler 22

The method of using the device of FIGS. 1 and 2 is illustrated in FIGS. 4 through 8. Referring first to FIGS. 4 and 5, a shield member 12 is attached to one end of the handle 14 by inserting the handle end 21 into the socket 20, as previously described The shield member 12 is then placed over the sprinkler 22 so that the entire sprinkler, including the rim 30, is covered. The adhesive ring 34 keeps the shield member 12 attached to the rim 30 when the handle 14 is removed from the socket 20 by a downward pull and a slight twist.

The steps of FIGS. 4, 5, and 6 are repeated for each sprinkler until all sprinklers are covered. The ceiling is then painted, as shown in FIG. 7, either with a paint sprayer 36 or with a roller (not shown) Finally, when the ceiling is completely painted, the shield members are removed by lightly rapping them with the handle 14 as shown in FIG. 8, to break the adhesion between the adhesive material and the rim.

The shield members 12 are advantageously made of lightweight plastic Their frusto-conical shape, which permits stacking, facilitates storage when not in use.

The handle 14 can be of whatever length is suitable for then height of the ceiling to be painted Lengths of about two to six feet will accommodate most ceilings. The handle can be a wooden pole, as shown in the drawings, or it can be a length of metal or plastic tubing.

A second preferred embodiment 50 of the invention is illustrated in FIGS. 9 through 12 This embodiment comprises a shield member 52 removably attachable to an elongate handle 54. The shield member 52 is in the form of a substantially frusto-conical cup, having a closed narrow end 56 and a wider open end 58, with a frusto-conical sidewall 59 therebetween. The closed end has a central, internally-threaded socket 60 that receives and attaches to an externally-threaded end 61 of the handle 54, as shown in FIG. 10 Like the shield member 12 of the previously-described embodiment, the shield member 52 of this second embodiment is dimensioned to cover a water sprinkler 22 having a sprinkler head 26, a protective receptacle 28 and a beauty rim 30.

Unlike the shield member 12 of the first embodiment, however, the shield member 52 of this second embodiment has no outwardly flared lip. Instead, the sides of the shield member near its open end 58 are dimensioned to encompass the beauty rim 30 of the sprinkler 22, with a small space between the beauty rim 30 and the interior surface of the shield member. This interior surface of the shield member 52 is provided with an adhesive ring 62. The adhesive ring 62 is preferably formed of a strip of double-sided tape, but other adhesive materials can be used. As shown in FIG. 10, the adhesive ring 62 adheres to the exterior surface of the beauty rim 30 when the shield member 52 is placed over the sprinkler 22.

An advantage of the configuration described above is that adhesive rings (particularly those formed of tape) can be used in a variety of thicknesses. As can be seen in FIG. 10, the space between the inner surface of the shield member 52 and the beauty rim 30 gradually increases from the open end 58 downward. Thus, thin tapes can be applied closer to the open end, while thicker tapes can be applied farther down the sides of the shield member.

A principal feature of this second embodiment is a plurality of inwardly-directed longitudinal ribs 64 in the shield member 52. The ribs 64 are preferably formed integrally with the contiguous side wall 59 of the shield member 52 by forming the shield member in a suitably-shaped mold (not shown), which forms the ribs 64 as longitudinal depressions 66 in the continuous exterior surface of the sidewall. There are at least three, and preferably four, equidistantly-spaced ribs, each starting about 1-7/16 inches 3.6 cm) from the open end 58, to provide clearance for the beauty rim 30, and extending to the closed end 56.

The ribs 64 have several important functions. First, as can be seen in FIG. 10, the upper portions of the ribs frictionally engage the protective receptacle 28 of the sprinkler 22, thereby providing an added degree of lateral support. This added support helps the shield member to remain in place against the pressure of a paint spray, and helps to minimize the accidental dislodging of the shield member when bumped by the painter. In many applications, the frictional engagement between the ribs 64 and the receptacle 28 will be sufficient to hold the shield member onto the sprinkler without the use of the adhesive ring 62.

Second, the abutment of the ribs 64 against the protective receptacle 28 limits the upward movement of the shield member. This is important where the sprinkler 22 is installed in a ceiling 68 formed of suspended tiles. The restraint on upward movement of the shield member imposed by the ribs 64 therefore prevents the ceiling tiles from being pushed out of place when the shield member 52 is installed.

Third, the ribs 64 add rigidity and strength to the shield members 52, with no increase in weight. This allows the shield members to be re-used many times.

Because the engagement between the ribs 64 ad the protective receptacle 28 makes the shield members somewhat harder to remove, it is necessary to employ the handle 54 with the threaded end 61 that fits into the threaded socket as shown in FIG. 10. In this respect, the method of using this second embodiment will differ from the method of using the first embodiment, in that removal of the shield members 52 involves threading the handle 54 into the socket and then pulling the shield member 52 off of the sprinkler, so as to release the ribs from the protective receptacle, rather than merely rapping it with the end of the handle.

It will be noted that the second embodiment, like the first embodiment, allows the shield members 52 to be stacked when not in use, because of the frusto-conical shape of the shield members, and because the ribs of one shield member will fit into the complementary depressions of another.

Although two specific preferred embodiments of the invention have been described above, various modifications will suggest themselves to those skilled in the pertinent parts. For example, the handles 14 and 54 can be of a telescoping construction, for maximum versatility. The shield members 12 and 52 can be made in a variety of sizes and configurations to accommodate sprinklers of diverse designs. The ribs 64 of the second embodiment can be made in different configurations and can be provided in any number greater than two.

Also, as previously mentioned, a side variety of adhesive materials are available for use as the adhesive ring 34. These and other modifications which may suggest themselves should be considered within the spirit and scope of the present invention, as defined in the claims which follow.

What is claimed is:

1. A device for shielding a ceiling-mounted water sprinkler, of the type having an annular protective receptacle surrounded by a concentric beauty rim, the device comprising:

an elongate handle having a threaded end;

a shield member having an open end, a closed end, and a side wall extending therebetween;

a threaded socket in the closed end adapted to attachably receive the threaded end of the handle; and at least three equidistantly spaced ribs in the interior of the shield member, and integral with the sidewall, for frictionally engaging the protective receptacle of the sprinkler when the shield member is placed over the sprinkler with the open end around the beauty rim wherein the ribs are formed by longitudinal depression in the outer surface of the side wall.

2. The device of claim 1, further comprising a strip of adhesive material applied to the inner surface of the shield member near the open end, the open end being internally dimensioned to allow the adhesive material to adhere to the beauty rim.

3. The device of claim 2, wherein the adhesive material is double-sided tape.

4. The device of claim 1, wherein the rib means comprises a plurality of inwardly-extending, longitudinal ribs formed integrally with the side wall of the shield member, the ribs being dimensioned and configured to be frictionally engageable with the protective receptacle.

5. The device of claim 4, wherein the shield member is substantially frustoconical, with the closed end being narrower than the open end, and wherein the side wall is defined by a continuous surface with the ribs being formed therein by longitudinal depressions in the outer surface of the side wall.

* * * * *